US006292963B1

(12) United States Patent
Couture

(10) Patent No.: US 6,292,963 B1
(45) Date of Patent: Sep. 25, 2001

(54) BED POCKET STORAGE SYSTEM

(76) Inventor: Luc Couture, 165 des Erables, Katevale, Quebec (CA), J0B 1W0

( * ) Notice: Subject to any disclaimer, the term of this patent is extended or adjusted under 35 U.S.C. 154(b) by 0 days.

(21) Appl. No.: 09/653,665

(22) Filed: Sep. 1, 2000

Related U.S. Application Data

(60) Provisional application No. 60/183,633, filed on Feb. 18, 2000.

(30) Foreign Application Priority Data

Sep. 2, 1999 (CA) ..... 2281358

(51) Int. Cl.[7] ..... A47C 21/00
(52) U.S. Cl. ..... 5/503.1; 5/658; 5/485
(58) Field of Search ..... 5/485, 486, 503.1, 5/658; 297/188.06, 188.2, 229, 4; 383/13, 22, 23

(56) References Cited

U.S. PATENT DOCUMENTS

| | | | | |
|---|---|---|---|---|
| 4,240,480 | * | 12/1980 | Strobel . | |
| 4,660,240 | * | 4/1987 | Hutton et al. | 5/658 |
| 4,662,016 | * | 5/1987 | Seeman | 5/658 |
| 5,279,009 | * | 1/1994 | Putka, Jr. | 5/485 |
| 5,533,809 | * | 7/1996 | Gorman . | |
| 5,581,829 | * | 12/1996 | Lee | 5/503.1 |
| 6,030,034 | * | 2/2000 | Plohetski | 297/188.06 |

* cited by examiner

*Primary Examiner*—Michael F. Trettel
(74) *Attorney, Agent, or Firm*—Eric Fincham

(57) ABSTRACT

A bedding accessory system which comprises a bed pocket having an opening therein and a fastening system which can be secured to the sheets of a bed without moving the mattress. The fastening system is a multipurpose one and can be adapted for different uses.

5 Claims, 2 Drawing Sheets

BED POCKET STORAGE SYSTEM

This application claims benefits of Provisional Application Ser. No. 60/183,633 filed Feb. 18, 2000.

FIELD OF THE INVENTION

The present invention relates to a storage device and more particularly, relates to a storage device which may be used in conjunction with a bed.

BACKGROUND OF THE INVENTION

As it has been discussed in the art, it is advantageous to have a storage device which is adjacent the bed. Such a storage device, which is often called a bed pocket, is desirable and useful for the storage of different articles such as reading material, glasses, keys and the like. The bed pocket provides ready access to such articles while preventing damage thereto.

Such bed pockets are known in the art and thus, when they refer to U.S. Pat. No. 4,129,909 which discloses a storage device for the storage of articles. There is shown a sheet like utilitarian member which reaches across and beyond the width of a bed so the pockets in the member hang along both sides of the bed.

A somewhat similar arrangement is shown in U.S. Pat. No. 5,581,829 wherein there are at least two layers having pockets for storing various items. As in the case of the previously mentioned patent, a strap stretches underneath the bed to secure the bed pockets in place. As will be appreciated, when it is necessary to remove the assembly for washing or the like, one must lift the mattress.

SUMMARY OF THE INVENTION

It is an object of the present invention to provide a bed pocket system which is aesthetically pleasing and which can be utilized in a number of different situations.

According to one aspect of the present invention, there is provided a bedding accessory system comprising a pocket formed to have an opening therein, a fastening system comprising a strap member having first and second ends, a first attachment at the first end of the strap member, the first attachment having means for securement to a sheet fabric material, a detachable fastener located at the second end of the strap member, the second fastener having first and second cooperative members, a first one of the members being secured to the second end of the strap member, and a second one of the members of the fastener being secured to the pocket proximate the opening thereto.

The bed pocket is preferably formed of a suitable fabric material and which fabric material is, in one embodiment, coordinated with a skirt which would conventionally surround the frame or box spring of a bed. In a preferred embodiment, the bed pocket is formed to have an outer layer and a lining and as such, can easily be fabricated on equipment known in the art for fabricating such items as pillow cases and the like. Thus, initially the lining and the fabric may be sewn together, folded in two, with the lining being placed interiorly of the fabric to form a finished bed pocket.

As will be discussed hereinbelow, a fastening system is provided for securing the bed pocket to a fabric material such as a sheet of the bed.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
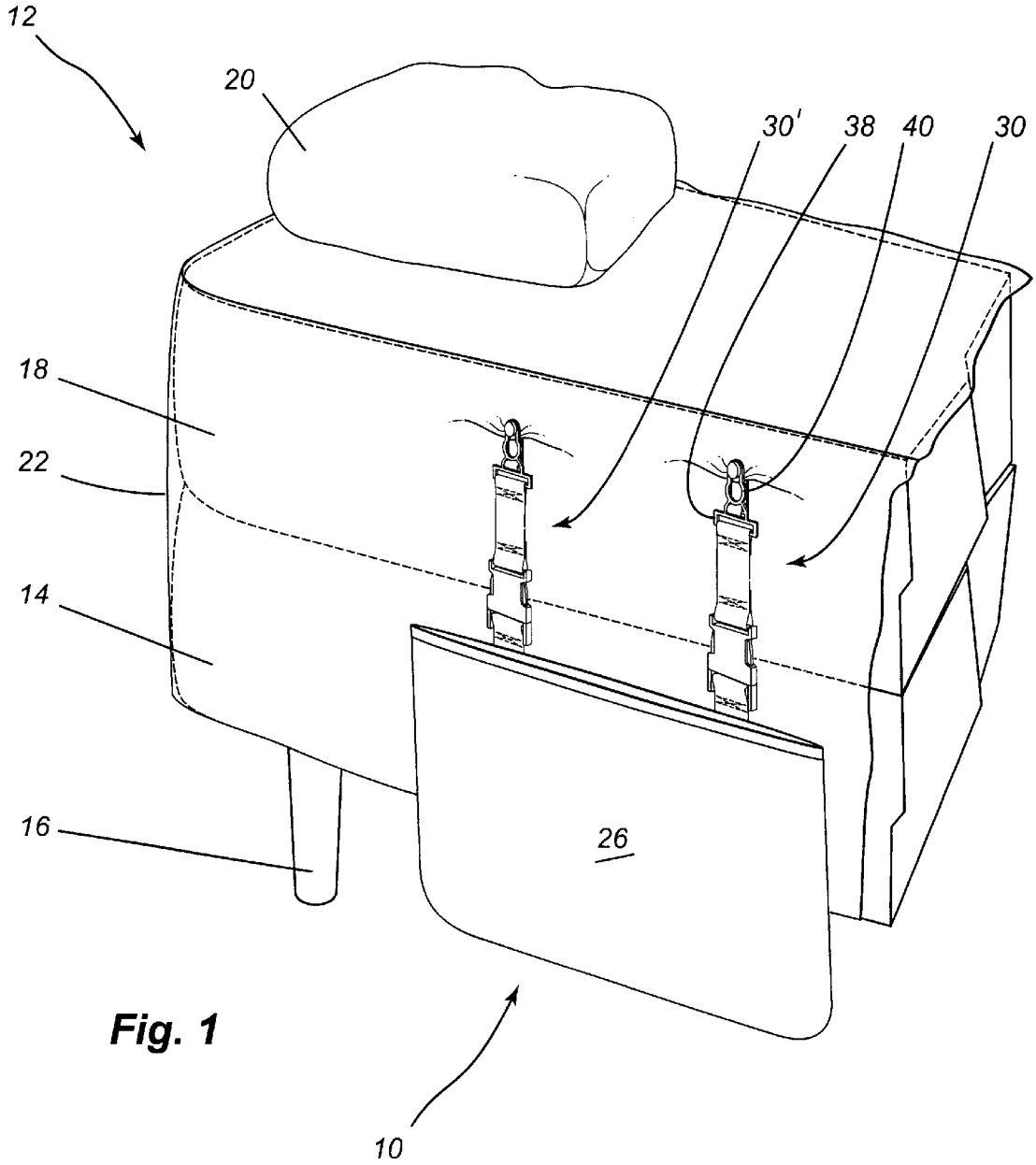
FIG. 1 is a perspective view of a bed pocket system according to one embodiment of the present invention.

Referring to the drawings in greater detail and by reference characters thereto, there is illustrated a bed pocket system in FIG. 1 and which bed pocket system is generally designated by reference numeral 10. Bed pocket system 10 is utilized in conjunction with a conventional bed designated by reference numeral 12 and which includes a box spring 14 which is mounted on legs 16. On top of box spring 14 there is provided a mattress 18. Shown in FIG. 1 is a pillow 20 and a sheet 22 covering mattress 18.

Secured to sheet 22 is a bed pocket 26 and which will now be discussed in greater detail. Bed pocket 26 is secured by means of a fastening system generally designated by reference numerals 30 and 30'.

Fastening system 30 includes a first fastener 34 located at one end of the fastening system 30. First fastener 34 is preferably formed of a plastic material and includes a first member 36 having a slot aperture 38 at one end thereof. At the other end of first member 36, there is provided a keyhole aperture generally designated by reference numeral 40. Secured to first member 36 is a flexible tongue member 42 which has a locking projection 44 extending outwardly therefrom and which locking projection is shaped to fit within keyhole aperture 40. This type of fastener is that which is sometimes referred to as a garter fastener.

Secured to first member 36 through slot aperture 38 is a strap member 46 which, in the illustrated embodiment, includes hook members 48 used in a hook and loop type of fastener such as is commonly marketed under the trademark VELCRO.

At the opposite end, strap 46 is secured to a plastic clip 52 for reasons which will become apparent hereinbelow.

Also secured to strap 46 is an elastic strap 54 which includes a fastener 56 at the opposed end thereof. Fastener 56 is similar to fastener 34 and thus includes a first member 58 having a slot aperture 60 formed therein and through which elastic strap 54 is secured. Similarly, there is provided a keyhole aperture (not shown) designed to receive locking projection 66 of tongue member 64.

There is also provided a plastic clip 74 designed to engage plastic clip 52. In this respect, plastic clip 52 may be of the female type and plastic clip 74 of the male type. These clips are well known and use a pair of outwardly extending prongs on the male portion to mate with the recesses on the female portion.

Figure 2:
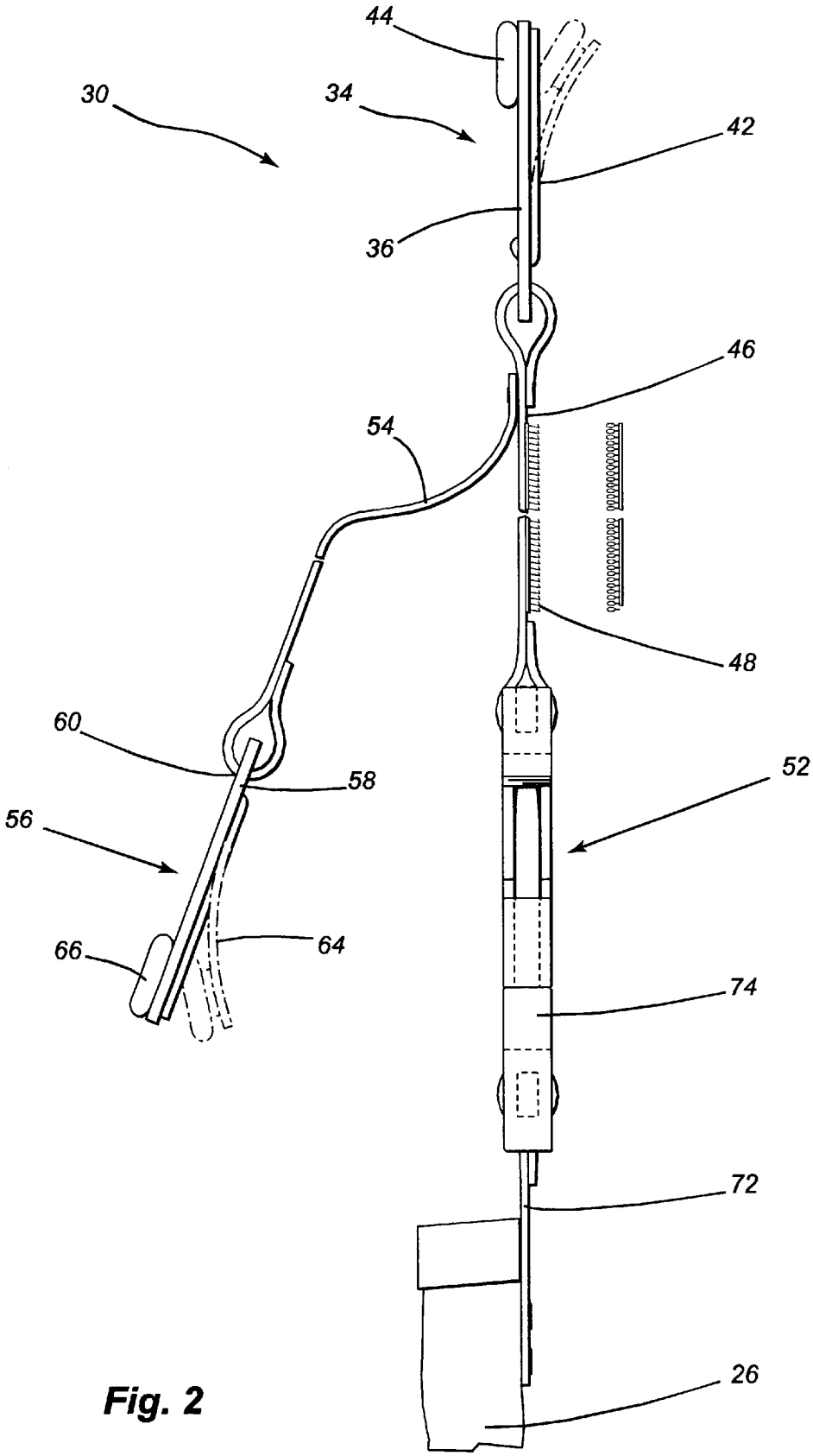
FIG. 2 is a side elevational view of the bed pocket fastening system according to the present invention.

As shown in FIG. 2, a strap 72 is connected to male plastic clip 74 and also is secured to bed pocket 26.

Fastening system 30' is substantially identical to fastening system 30 and thus will not be described herein.

Bed pocket 26 may be, as previously discussed, any suitable type and preferably is designed to match the bed material. Alternatively, bed pocket 26 could be any suitable container which could be detached and used as required—as a youngster's knapsack or the like.

It will be understood that the above described embodiment is for purposes of illustration only and that changes and modifications may be made thereto without departing from the spirit and scope of the invention.

I claim:

1. A bedding accessory system comprising:

a pocket formed to have an opening therein;

a fastening system comprising a first strap member having first and second ends;

a first attachment at said first end of said first strap member, said first attachment having means for securement to a sheet fabric material; detachable fastener having first and second cooperative members, a first one of said cooperative members being secured to said second end of said first strap member;

a second one of said cooperative members of said fastener being secured to said pocket proximate said opening thereto; and a second strap, said second strap having a second strap first end secured to said first strap member, and an attachment located at a second end of said second strap.

2. The bedding accessory system of claim 1 wherein said first and second cooperative members comprise a plastic clip having a male portion and a female portion.

3. The bedding accessory system of claim 1 wherein said first attachment at said first end of said first strap member comprises a garter type attachment having a keyhole shaped aperture formed therein and a tongue having a locking projection sized to fit within said keyhole aperture and to retain said sheet fabric material therebetween.

4. The bedding system of claim 1 wherein said first strap member has one of a hook and loop fastener type formed on one surface thereof.

5. The bedding accessory of claim 1 wherein said pocket is formed of sheet material having a pattern thereon corresponding to a pattern of a bed sheet.

* * * * *